US007874614B2

(12) United States Patent
Figueras Mitjans

(10) Patent No.: US 7,874,614 B2
(45) Date of Patent: Jan. 25, 2011

(54) SYSTEM FOR MOUNTING WRITING TABLETS TO ARMCHAIRS

(75) Inventor: José Figueras Mitjans, Llicá d'Amunt (ES)

(73) Assignee: Figueras International Seating, S.A., Llica d'Amunt (Barcelona) (ES)

( * ) Notice: Subject to any disclaimer, the term of this patent is extended or adjusted under 35 U.S.C. 154(b) by 267 days.

(21) Appl. No.: 12/223,533

(22) PCT Filed: Dec. 27, 2006

(86) PCT No.: PCT/ES2006/000711

§ 371 (c)(1),
(2), (4) Date: Aug. 1, 2008

(87) PCT Pub. No.: WO2007/088219

PCT Pub. Date: Aug. 9, 2007

(65) Prior Publication Data

US 2009/0026812 A1 Jan. 29, 2009

(30) Foreign Application Priority Data

Feb. 3, 2006 (ES) ..... 200600242

(51) Int. Cl.
*A47B 39/00* (2006.01)
*A47B 83/02* (2006.01)

(52) U.S. Cl. ..... 297/145; 297/162

(58) Field of Classification Search ..... 297/145, 297/162

See application file for complete search history.

(56) References Cited

U.S. PATENT DOCUMENTS

| | | | | | |
|---|---|---|---|---|---|
| 2,845,113 | A * | 7/1958 | Keel | 297/145 |
| 3,298,735 | A * | 1/1967 | Berman | 297/145 |
| 3,467,432 | A * | 9/1969 | Sullivan | 297/162 |
| 3,583,760 | A * | 6/1971 | McGregor | 297/145 |
| 4,944,552 | A * | 7/1990 | Harris | 297/145 |
| 5,050,929 | A * | 9/1991 | Gueringer et al. | 297/145 |
| 5,547,247 | A * | 8/1996 | Dixon | 297/145 |
| 5,683,136 | A * | 11/1997 | Baumann et al. | 297/162 |
| 5,927,799 | A * | 7/1999 | Tornero | 297/145 |
| 7,798,072 | B2 * | 9/2010 | Becker et al. | 297/145 X |

* cited by examiner

*Primary Examiner*—Rodney B White
(74) *Attorney, Agent, or Firm*—The Nath Law Group; Jerald L. Meyer; Brooks Gifford, III

(57) ABSTRACT

A system for mounting writing tablets to armchairs includes a slide guide mounted inside the armrest of the armchair. The writing tablet is slidable on the slide guide between a concealed position inside the armrest and a projecting position outside the armrest. A support is rotatably attached to the armrest and includes an upper stop element that can be adjusted to ensure the writing tablet is horizontal when in use.

9 Claims, 10 Drawing Sheets

SYSTEM FOR MOUNTING WRITING TABLETS TO ARMCHAIRS

FIELD OF THE ART

The present invention relates to the arrangement of writing tablets in a foldable assembly with respect to armchairs, proposing an implementation of mounting said writing tablets which provides very advantageous functional features.

STATE OF THE ART

In conference room armchairs or the like, in which the use can require a support for writing or handling documents, the arrangement of writing tablets for such purpose is known, which tablets are generally incorporated in one of the sides or armrests of the corresponding armchair.

According to a known embodiment, the mentioned writing tablets are arranged in a hinged mounting which allows placing them in a horizontal position in front of the seat in the armchair, as well as refolding them to a withdrawn position which allows freeing up the access to the seat.

There are solutions for these types of assemblies, such as those included in Utility Models ES 295,589 and ES 295,593, from the same proprietor as this application, in which in order to pass the writing tablet from the rest position to the use position or vice versa, it is necessary to rotate the tablet so that it is placed above the upper part of the side of the armchair, in order to then lower said tablet to the use position or to the withdrawn position, as appropriate.

There are solutions of this type, such as that of Utility Model ES 200302530, also of the same applicant, with an antipanic concept, including to that end an arrangement facilitating the refolding of the writing tablet to the withdrawn position by means of simply pushing the corresponding writing tablet.

All the mentioned solutions include however a functional dual rotation arrangement of the writing tablet in order to pass from the use position to the withdrawn position or vice versa, which requires a complicated mechanism, since it must provide a rotation of the writing tablet on two different shafts, combining both movements.

There is also a solution, such as that of Utility Model ES 9505266, also of the same applicant, in which the writing tablet is mounted on a slide guide in order to be concealed in the side of the armchair, with the rotation of the tablet on a single hinge shaft in order to pass from the use position to the withdrawn position or vice versa, providing a dampening counterweight in order to prevent the sudden drop through the guide, which makes the mechanism as well as the adjustment so that the functional behavior is suitable rather complicated.

OBJECT OF THE INVENTION

According to the invention, a system for mounting writing tablets to armchairs is proposed, according to the incorporation arrangement on a guide for the insertion and removal with respect to the corresponding armrest of the armchair, with particular features improving the functional aspect of said mounting in the application function.

The writing tablet object of the mounting is provided in a hinged coupling with respect to a carriage which is in turn arranged in a sliding coupling on a guide provided in the armrest of the armchair, in order to carry out a vertical slide for concealing the writing tablet in the armrest of the armchair and for exiting through the upper part in order to place it in the use position.

According to the invention, the carriage is coupled on the slide guide by means of three wheels which are supported on both sides of the guide, one of said wheels being provided on an eccentric shaft, by means of which the tightness of the mounting on the guide can be adjusted in order to adjust the lightness of the sliding.

In the lower part of the sliding course of the carriage there is arranged an elastic stop element, against which the carriage is supported on that lower part, a dampening therefore occurring which prevents the abruptness of the stop blow in the drop of the moving assembly to the concealed position of the writing tablet in the armrest of the armchair.

In the upper part of the sliding course of the carriage, there is arranged in turn a stop element limiting the course of the carriage in that upper part, preventing it from coming out of the guide and acting as a containment for maintaining the writing tablet in the horizontal use position.

Said upper stop element is provided in a support which is secured on the structure of the armrest of the armchair by means of two fixing points, one of the points forming a rotating shaft, whereas the other point determines a mounting hole which allows varying the angular position of the support, the position in height of the stop element thus being able to be adjusted in order to adjust the horizontalness of the writing tablet in the use position.

The writing tablet itself provides an elastic stop element on the rear face in order to be supported on the upper edge of the armrest of the armchair in the horizontal use position, insofar as the writing tablet is arranged in an off-centered outward position with respect to the thickness of the armrest of the armchair, thus allowing a greater distance between the support point on the upper part of said armrest of the armchair and the attachment with the sliding carriage, which is where the counter-support retention for maintaining the tablet in the horizontal position is made.

A torsion spring is included in the hinged attachment of the writing tablet with the bearing carriage, which spring aids in raising the tablet when actuating the raising from the use position to the vertical position for the drop into the armrest of the armchair, automating said raising from a certain angle, about 45° for example.

In addition an embodiment of the writing tablet in a transverse or longitudinal fold is provided, whereby enabling an unfolding in order to increase the useful surface of the tablet when desired.

An embodiment with very advantageous features is thus obtained, acquiring its own identity and a preferred character with respect to systems for mounting and arranging writing tablets to armchairs according to the conventional ways.

DETAILED DESCRIPTION OF THE INVENTION

Figure 1:
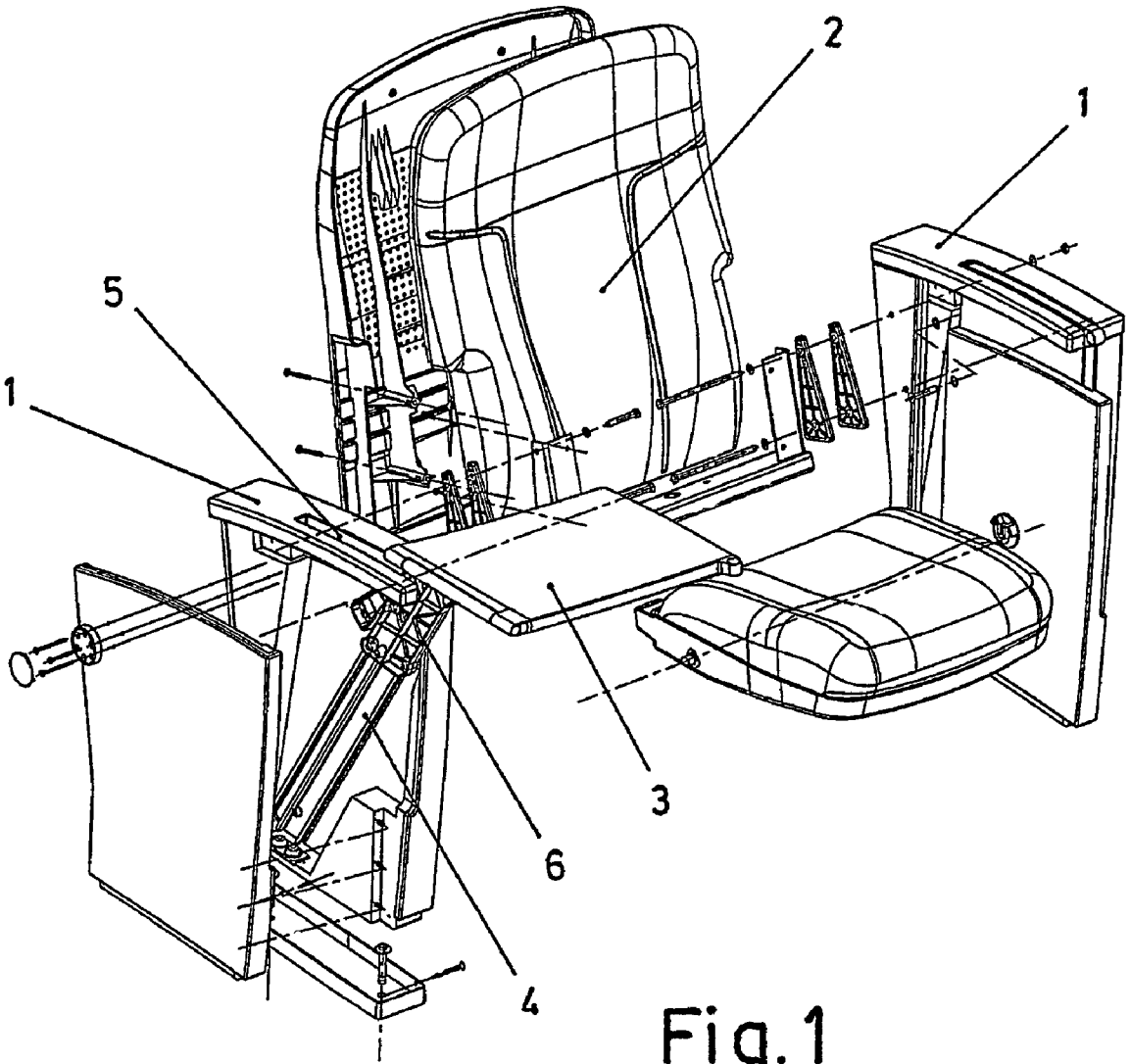
FIG. 1 shows an exploded perspective view of the assembly of an armchair with writing tablets provided in the armrests according to the invention.
Figure 2:
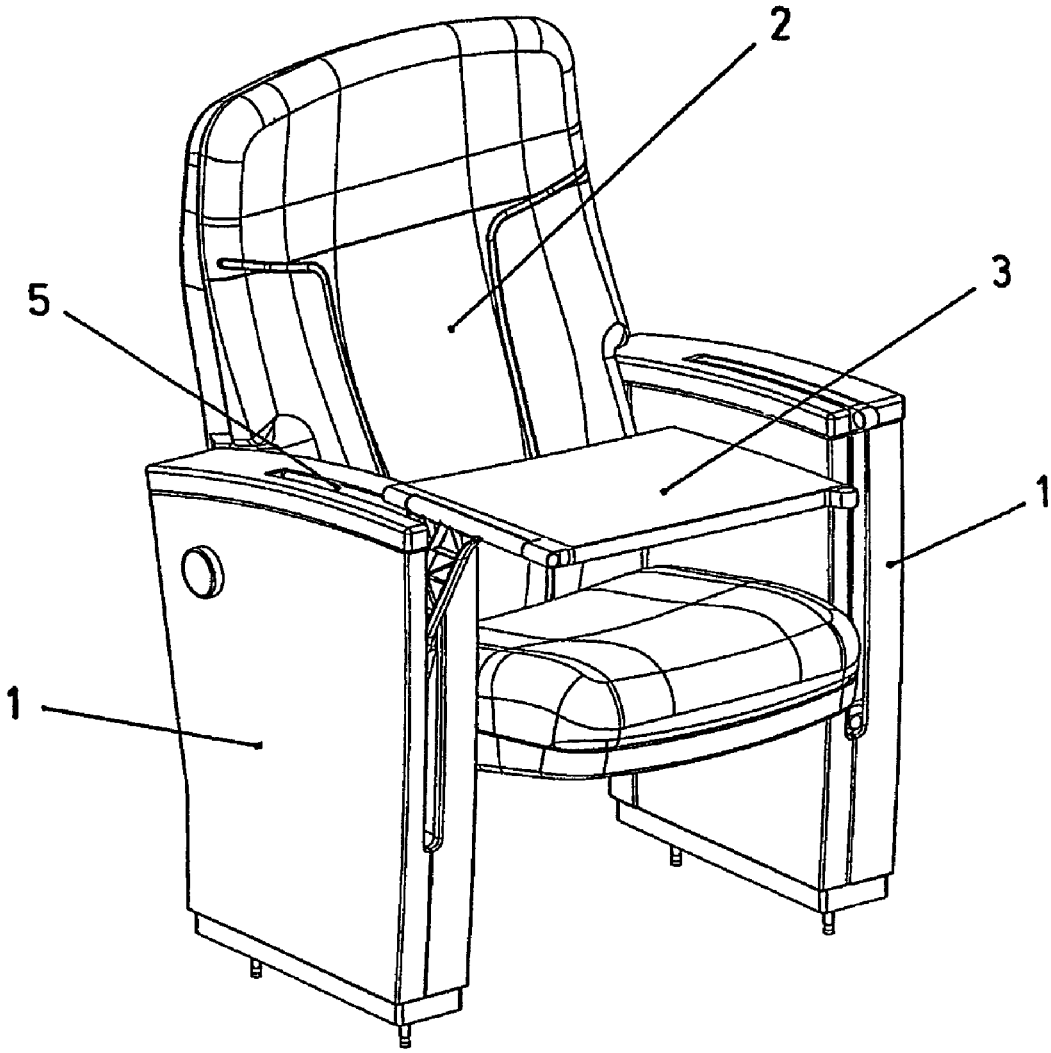
FIG. 2 is a perspective view of the previous armchair mounted, with the writing tablet of an armrest in the use position.
Figure 3:
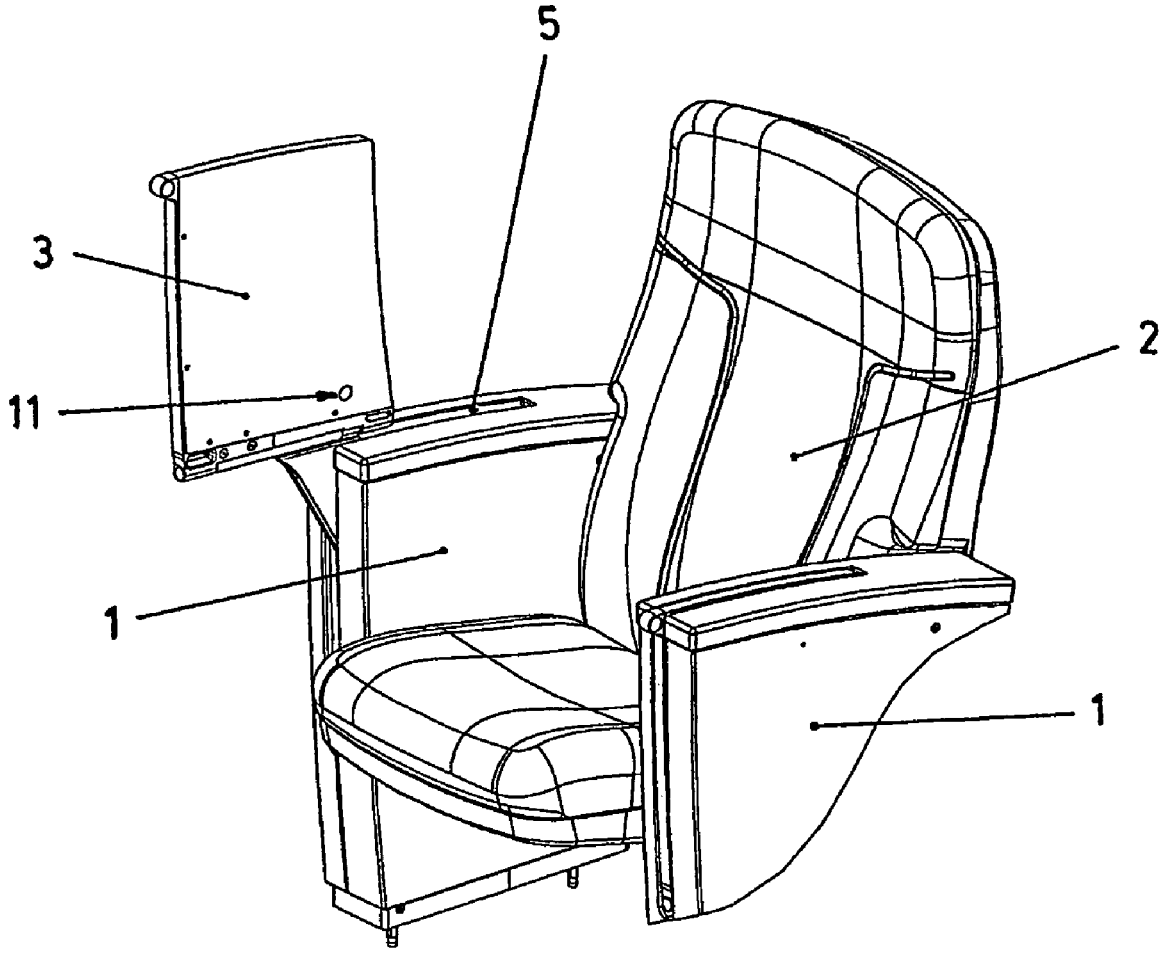
FIG. 3 is a partial perspective view of the previous armchair, with the writing tablet raised in the vertical position on the corresponding armrest.
Figure 4:
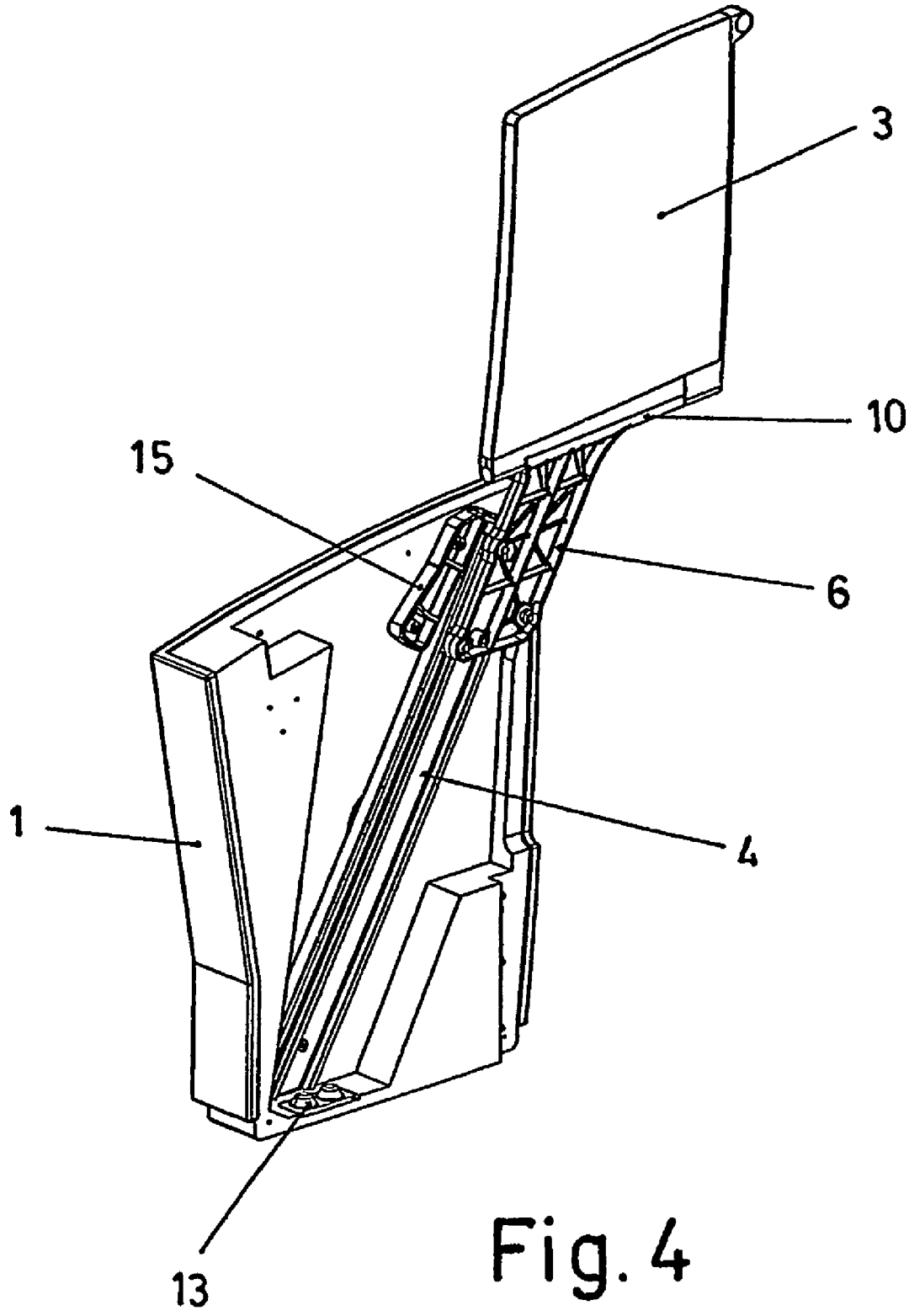
FIG. 4 is a perspective view of an armrest of the armchair without the front cover and with the corresponding writing tablet vertically raised upwards.
Figure 5:
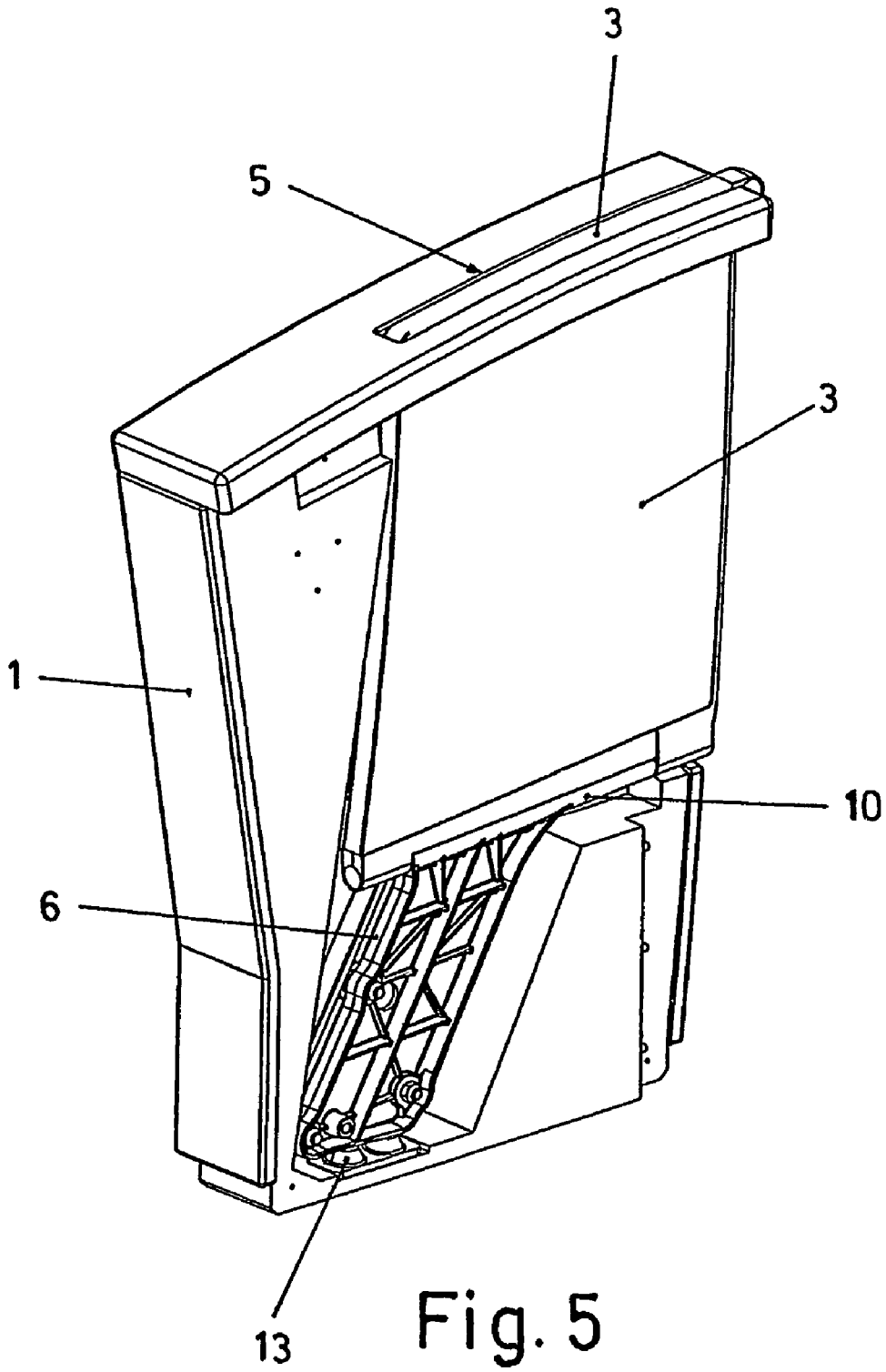
FIG. 5 is a perspective view of the same armrest of the armchair with the writing tablet withdrawn inside.
Figure 6:
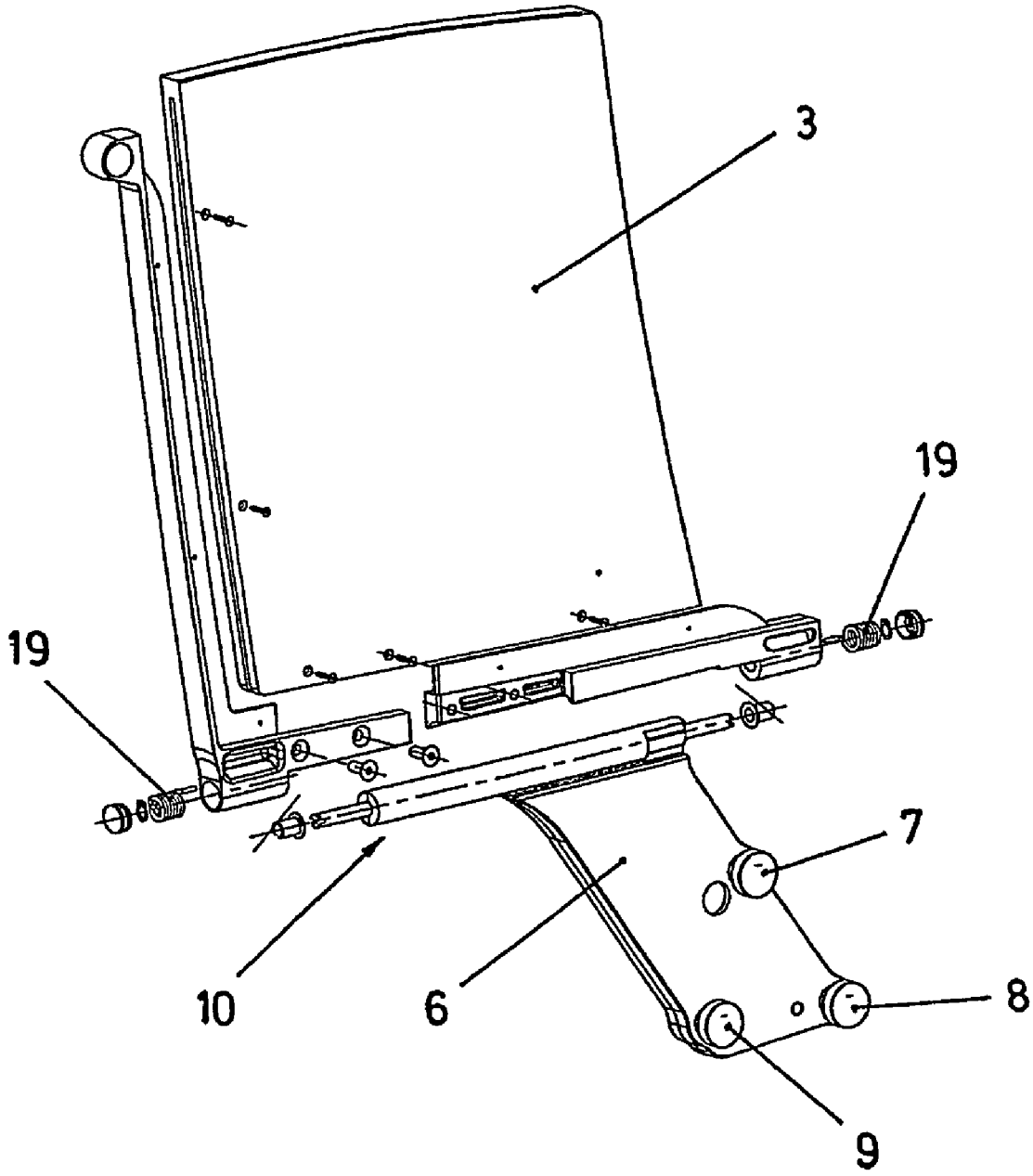
FIG. 6 is an exploded perspective view of the hinged coupling of a writing tablet on the mounting bearing carriage.
Figure 7:
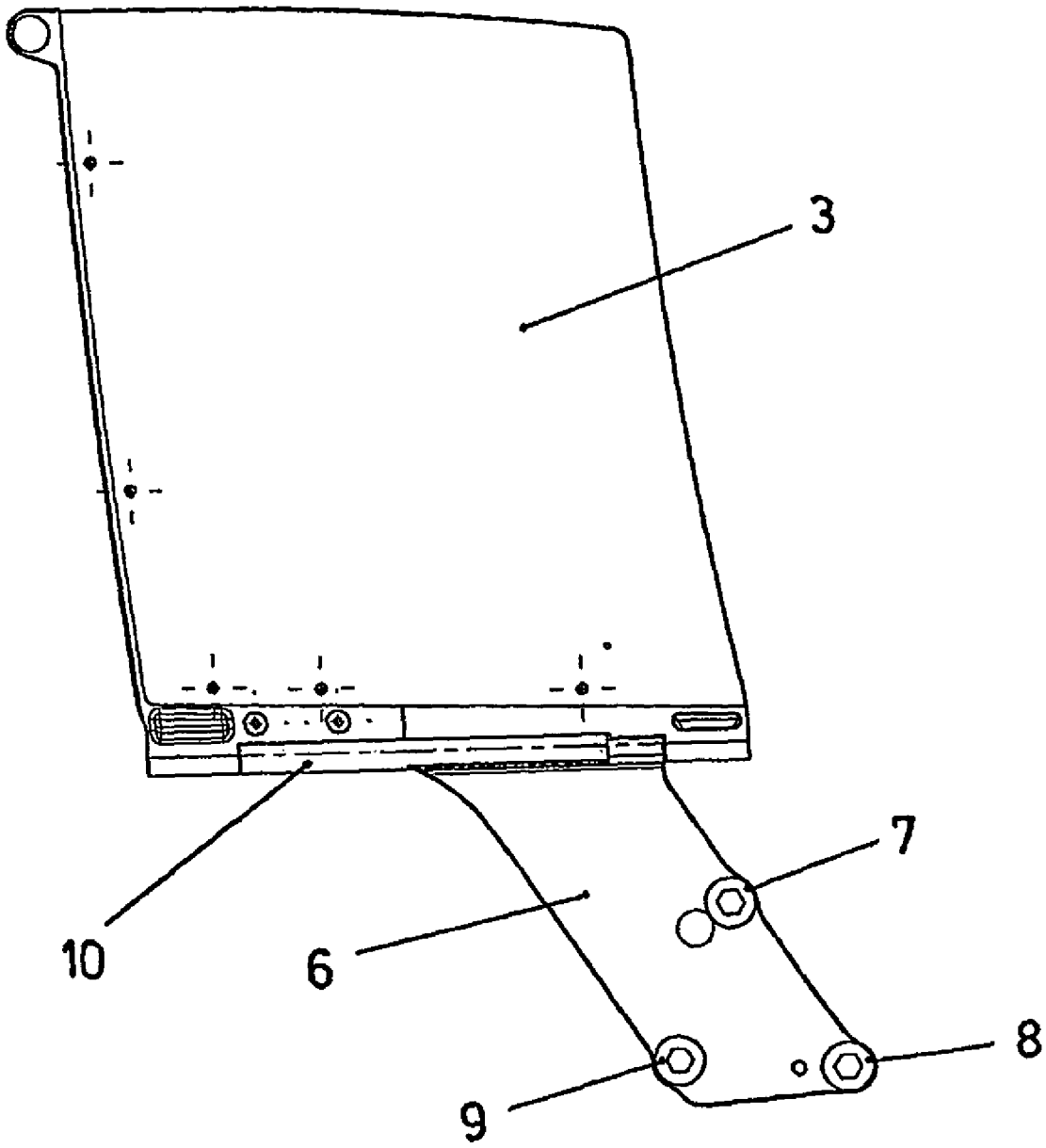
FIG. 7 is a perspective view of the previous assembly attached according to the hinged mounting.

The object of the invention relates to the system for mounting writing tablets which are provided in the armrests (1) of armchairs (2), according to an embodiment of said mounting provided with particular features improving the functional aspect.

According to the invention, the writing tablet (3) corresponding to the proposed mounting is arranged in relation to a guide (4) provided inside the corresponding armrest (1), such that said armrest (1) determines in the upper part a groove (5) through which the writing tablet (3) can enter and exit.

With respect to the guide (4), the writing tablet (3) is slidingly coupled by means of a carriage (6), which has an assembly of three wheels (7, 8 and 9), two of which wheels (7 and 8) are supported on one side and the other wheel (9) is supported on the other side, on the guide (4), providing an assembly which allows vertically moving the writing tablet (3), which by means of said movement can be concealed inside the armrest (1) and be removed to the outside through the groove (5).

The writing tablet (3) is attached to the carriage (6) by means of a hinge (10), such that the writing tablet (3) can rotate on said hinge (10) with the possibility of pivoting between a horizontal position and a vertical position, which, combined with the movement along the guide (4) by means of the carriage (6), allows introducing the writing tablet (3) inside the armrest (1) in order to be concealed in a withdrawn position, and removing it for its horizontal placement in a use position in front of the seat of the corresponding armchair (2).

In the horizontal use position the writing tablet (3) is supported on the upper part of the armrest (1), the tablet (3) itself incorporating for such purpose an elastic element (11) on the rear face, by means of which the support is provided, whereas the armrest (1) is arranged outwardly off-centered, thus allowing a greater distance between the support point by means of the element (11) and the hinge (10) with the carriage (6), which acts as a counter-support retention in order to reduce the stress of maintaining the writing tablet (3) in the mentioned horizontal use position.

Figure 8:
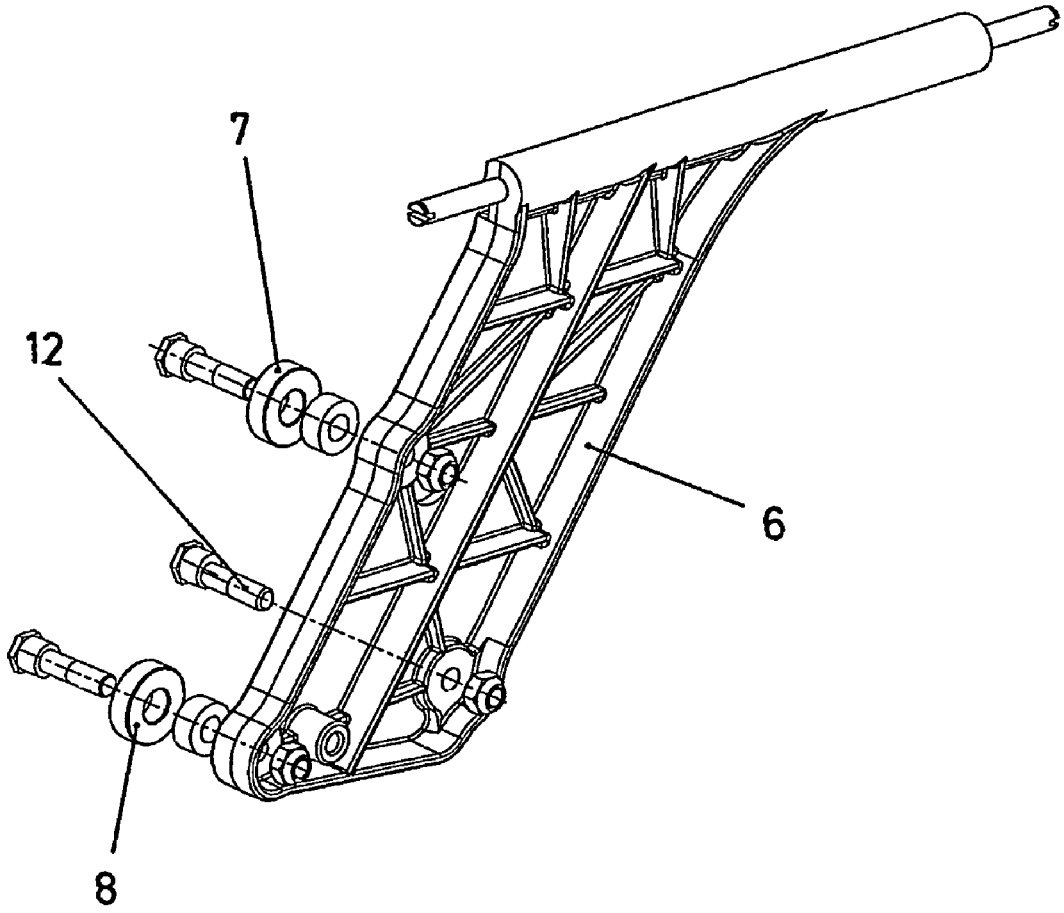
FIG. 8 is an enlarged perspective view of the bearing carriage for bearing a writing tablet according to the invention, with the wheels of the sliding assembly in an exploded view.

The vertical movement of the writing tablet (3) for taking it from the withdrawn position to the use position and vice versa, is carried out by means of rolling the carriage (6) on the guide (4), the lightness of said movement being adjusted in order to prevent the sudden drop of the moving assembly, by means of the tightness of the wheels (7, 8 and 9) on the guide (4), for which the independent wheel (9) is provided on an eccentric shaft (12), as seen in FIG. 8, which allows regulating the tightness of the mounting pressure on the guide (4) for the purpose of adjusting the lightness of the sliding movement.

Nevertheless, in the lower part of the movement course, there is arranged an elastic stop element (13), on which the carriage (6) is supported when it reaches that lower part, the blow of the drop of the moving assembly in that lower end of the course thus being dampened.

In the upper part of the movement course, there is arranged a stop element (14) limiting the movement and preventing the carriage (6) from coming out of the guide (4), such that said stop element (14) also determines, depending on its position, the leveling of the writing tablet (3) in the horizontal use position.

Figure 9:
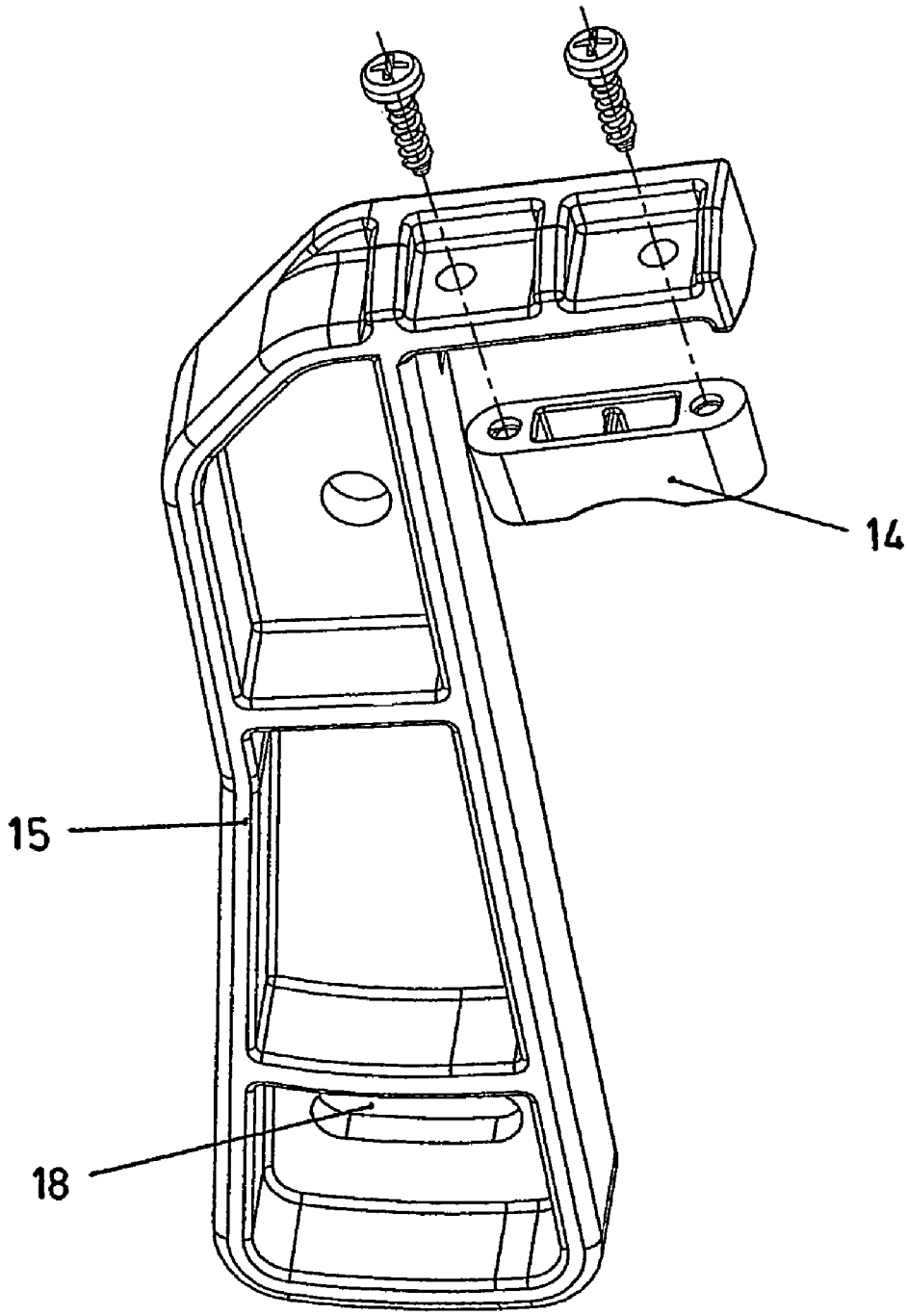
FIG. 9 is an enlarged perspective view of the upper stop element of the guided mounting of a writing tablet according to the invention, with the stop element in a mounted position with respect to the corresponding support.
Figure 10:
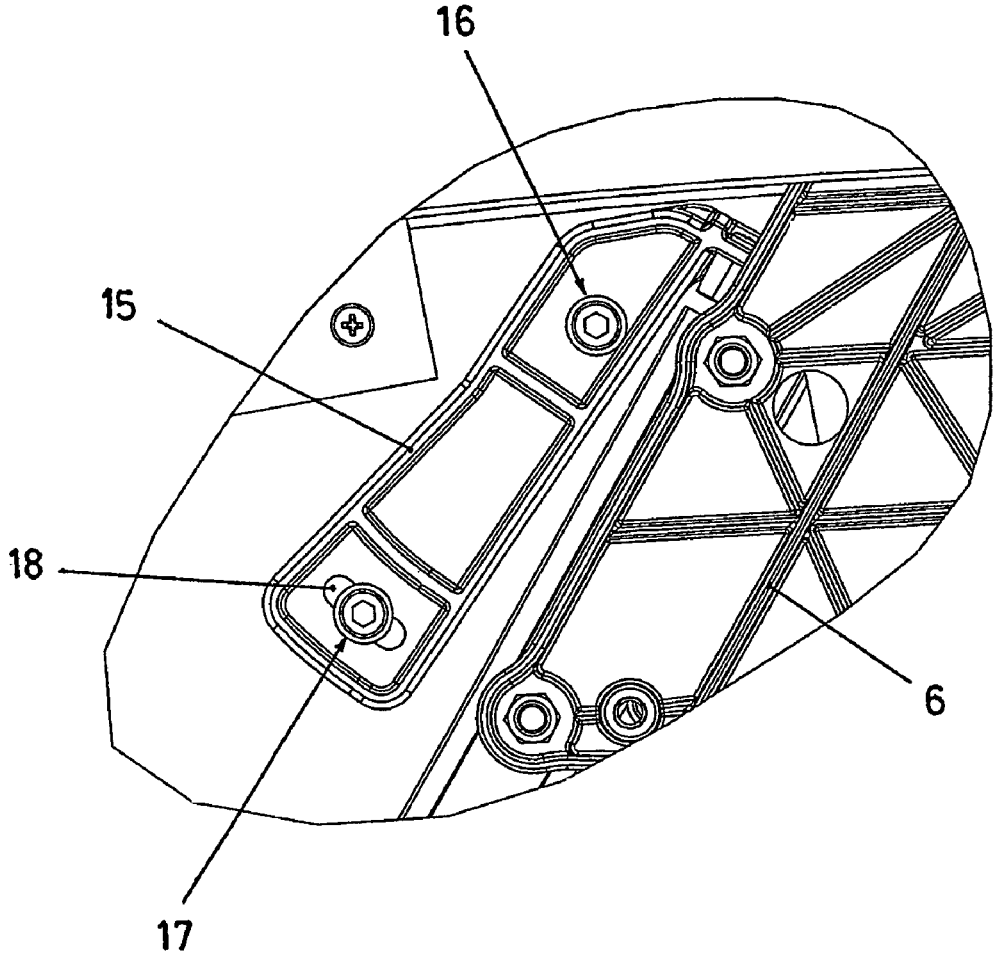
FIG. 10 is an enlarged detail of the arrangement of the upper stop element in the guided mounting of a writing tablet according to the invention.

According to the aforementioned, the upper stop element (14) is provided on a support (15) which is fixed on the structure of the armrest (1) by means of two securing points (16 and 17), one of which points (16) forms a rotating shaft, whereas the other point (17) is provided in relation to a mounting hole (18) of the support (15), according to FIGS. 9 and 10, allowing that securing assembly to vary the position of the support (15) by means of rotating same with respect to the point (16) and fixing in the desired position by means of the point (17), which makes the height of the stop element (14) vary and consequently the leveling of the writing tablet (3) can be adjusted so that it is perfectly horizontal in the use position.

The hinge (10) by means of which the writing tablet (3) is attached to the carriage (6), includes torsion springs (19), which act by collaborating as an aid in raising the writing tablet (3) to the vertical position from the horizontal use position, automating said raising from a certain angle (for example 45°) of the raising, whereas in the lowering from the vertical position to the horizontal position said springs (19) act as a dampener, preventing the sudden drop of the tablet (3).

The proposed mounting therefore allows passing the writing tablet (3) from the horizontal use position in front of the seat of the armchair (2) to the withdrawn position inside the corresponding armrest (1), by means of a simple initial push for raising to the vertical position, such that from an angle the raising is completed by itself to the vertical position, as a result of the springs (19), and from the vertical position the assembly of the tablet (3) with the carriage (6) drops by itself into the armrest (1) sliding through the guide (4).

In the withdrawn position of the writing tablet (3) inside the armrest (1), the upper edge of the writing tablet (3) coincides with the groove (5) of the armrest (1), it being provided that said edge of the writing tablet corresponds with the shape of the upper surface of the armrest (1), such that it determines a perfecta continuity of said surface when the writing tablet (3) is withdrawn.

In an embodiment, which does not alter the mounting, the writing tablet (3) can comprise an assembly folded in a longitudinal or transverse direction, allowing an unfolding in order to increase the useful surface in the use when desired.

The writing tablet (3) can likewise be provided with shapes and/or cuts which facilitate using the armchair (2) with the tablet (3) in a use position for obese people, the tablet (3) in its mounting securing also being able to be arranged for such purpose by means of a ball joint set, a solution for guiding with respect to the carriage (6), longitudinal movement elasticity on the hinge (10), or any other arrangement which allows increasing the separation between the tablet (3) and the backrest of the armchair (2) when needed.

The invention claimed is:

1. A system for mounting writing tablets to armchairs, comprising a writing tablet arranged in a sliding assembly with respect to a guide provided inside an armrest of an armchair, with the possibility of sliding between a concealed position inside the armrest and a removed position at an upper part of the armrest from which the writing tablet is lowered to a horizontal position in front of a seat of the armchair, wherein in relation to a lower part of the guide inside the armrest there is arranged an elastic stop element on which the sliding assembly for bearing the writing tablet is supported when the sliding assembly falls to the concealed position, whereas in the upper part of the guide there is arranged an upper stop element which limits upward sliding of the sliding assembly, while at the same time providing a retention establishing the writing tablet in the horizontal position, said upper stop element being provided on a support rotatably affixed to the armrest which can be adjusted to ensure that the horizontal position of the writing tablet is level.

2. The system of claim 1, wherein the support of the upper stop element is secured by first and second fixing points the first fixing point forming a rotating shaft, the second fixing point being provided in a mounting hole of the support to allow varying the position of the support rotating on the first fixing point to vary the height of the upper stop element.

3. The system of claim 1, wherein the sliding assembly of the writing tablet is a carriage provided on the guide with first, second and third wheels, such that the first and second wheels are supported on a first side of the guide and the third wheel is supported on a second side of the guide, the third wheel being mounted independently on an eccentric shaft to allow varying the pressure of the carriage on the guide for adjusting lightness of the sliding.

4. The system of claim 3, wherein the writing tablet is attached to the carriage by a hinge provided with torsion springs collaborating in the rotation of the writing tablet between the horizontal position and an intermediate vertical position above the armrest, thereby automating raising of the writing tablet to the intermediate vertical position from an initial actuation angle.

5. The system of claim 1, wherein the writing tablet is attached to the carriage by a hinge provided with torsion springs collaborating in the rotation of the writing tablet between the horizontal position and an intermediate vertical position above the armrest, thereby automating raising of the writing tablet to the intermediate vertical position from an initial actuation angle.

6. The system of claim 1, wherein the writing tablet has a rear face with an elastic element to support the writing tablet on the upper part of the armrest in the horizontal position.

7. The system of claim 1, wherein the writing tablet can be structured with a transverse or longitudinal fold, allowing an unfolding of the writing tablet for increasing a use surface of the writing tablet.

8. The system of claim 1, wherein the writing tablet is slidable forward and rearward with respect to the backrest of the armchair.

9. An armchair with integral writing tablet, comprising:

an armchair having an armrest with a groove with an internal carriage guide;

a carriage slidably mounted to the internal carriage guide of the groove of the armrest;

a writing tablet hingedly connected to the carriage and movable between a concealed position inside the armrest and a horizontal position outside the armrest;

a support rotatably affixed to the armrest, the support comprising:

an upper stop element that prevents the carriage and writing tablet from exiting an upper end of the internal carriage guide; and a mounting aperture;

wherein the support is rotatably affixed to the armrest by first and second fixing points, the first fixing point forming a rotating shaft and the second fixing point being disposed inside the mounting aperture of the support; and wherein the height of the upper stop element is variable by rotating the support relative to the armrest; and wherein the angle of the writing tablet relative to horizontal is variable by varying the height of the upper stop element.

* * * * *